US005695610A

United States Patent [19]

Auhorn et al.

[11] Patent Number: 5,695,610

[45] Date of Patent: Dec. 9, 1997

[54] AQUEOUS PIGMENT SLURRIES AND THEIR USE IN THE PRODUCTION OF FILLER-CONTAINING PAPER

[75] Inventors: Werner Auhorn, Frankenthal; Friedrich Linhart, Heidelberg; Dietmar Mönch, Weinheim; Jürgen Weiser, Schriesheim; Primoz Lorencak, Ludwigshafen, all of Germany

[73] Assignee: BASF Aktiengesellschaft, Ludwigshafen, Germany

[21] Appl. No.: 612,828

[22] PCT Filed: Oct. 6, 1994

[86] PCT No.: PCT/EP94/03304

§ 371 Date: Mar. 15, 1996

§ 102(e) Date: Mar. 15, 1996

[87] PCT Pub. No.: WO95/10662

PCT Pub. Date: Apr. 20, 1995

[30] Foreign Application Priority Data

Oct. 15, 1993 [DE] Germany ..... 43 35 194.8

[51] Int. Cl.[6] ..... D21H 17/56; D21H 17/55; D21H 17/54

[52] U.S. Cl. ..... 162/164.6; 162/166; 162/168.1; 162/168.2; 162/158; 106/400; 106/465; 106/471; 106/499

[58] Field of Search ..... 162/164.6, 166, 162/168.1, 168.2, 183, 158; 106/400, 465, 471, 499, 464, 463

[56] References Cited

U.S. PATENT DOCUMENTS

| | | | |
|---|---|---|---|
| 3,325,346 | 6/1967 | Osborg | 162/183 X |
| 3,418,204 | 12/1968 | Goldstein et al. | 162/183 X |
| 3,925,095 | 12/1975 | Böckmann et al. | 106/499 X |
| 3,998,652 | 12/1976 | Aign et al. | 106/499 |
| 5,059,248 | 10/1991 | Signorino et al. | 106/402 |
| 5,131,951 | 7/1992 | Yoshida et al. | 106/400 X |
| 5,158,611 | 10/1992 | Ura et al. | 106/499 |
| 5,169,441 | 12/1992 | Lauzon | 106/416 |

*Primary Examiner*—Donald E. Czaja
*Assistant Examiner*—José A. Fortuna
*Attorney, Agent, or Firm*—Oblon, Spivak, McClelland, Maier & Neustadt, P.C.

[57] ABSTRACT

Aqueous pigment slurries which contain up to 80% by weight of a finely divided pigment in dispersed form and from 0.1 to 5% by weight of a water-soluble reaction product of (a) a polyamidoamine grafted with ethyleneimine and (b) a bifunctional or polyfunctional crosslinking agents which have a halohydrin, glycidyl, aziridine or isocyanate unit or a halogen atom as a functional group, the reaction product, in 25% strength by weight aqueous solution at 20° C., having a viscosity of at least 100 mPa.s, are used as an additive to the paper stock in the production of filler-containing paper.

4 Claims, No Drawings

AQUEOUS PIGMENT SLURRIES AND THEIR USE IN THE PRODUCTION OF FILLER-CONTAINING PAPER

CROSS-REFERENCE TO ELATED APPLICATION

This application is a 35 U.S.C. 371 of PCT/EP94/03304 filed Oct. 6, 1994.

BACKGROUND OF THE INVENTION

1. Field of the Invention

The present invention relates to aqueous pigment slurries which contain up to 80% by weight of a finely divided pigment in dispersed form and from 0.1 to 5% by weight of at least one dispersant, and the use of the aqueous pigment slurries as an additive to the paper stock in the production of filler-containing paper.

2. Description of the Related Art

An efficient dispersant is required for the preparation of highly concentrated aqueous pigment slurries having a low viscosity. Known dispersants are, for example, low molecular weight polyacrylic acids. They can be prepared, for example, by the process disclosed in EP-B-0 002 771, by polymerization of acrylic acid in isopropanol at relatively high temperatures and pressures.

U.S. Pat. No. 3,945,843 furthermore discloses the use of copolymers of methyl acrylate and acrylic acid as dispersants for the preparation of highly concentrated pigment slurries, such as calcium carbonate slurries. The pigment slurries have solids contents of from 50 to 80% by weight and are used for coating paper. However, the concentrated aqueous pigment slurries described above cannot be used in the production of filler-containing papers because the low molecular weight polyacrylic acids contained in the pigment slurries greatly interfere with the efficiency of drainage aids, retention aids and sizes.

The prior German Application P 43 06 608.9 which has not been previously published discloses aqueous pigment slurries which contain up to 80% by weight of a finely divided pigment in dispersed form and from 0.1 to 5% by weight of a dispersant. The dispersants used are reaction products which are obtainable by reacting (a) polyalkylenepolyamines, polyamidoamines, polyamidoamines grafted with ethyleneimine, polyetheramines and mixtures of the stated compounds with (b) monoethylenically unsaturated carboxylic acids, salts, esters, amides or nitriles of monoethylenically unsaturated carboxylic acids, chlorocarboxylic acids and/or glycidyl compounds of the formula

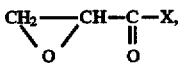

(I)

where

X is —$NH_2$, —OMe or —OR,

Me is H, Na, K or ammonium and

R is $C_1$–$C_4$-alkyl or $C_2$–$C_4$-hydroxyalkyl, and, if required, (c) bifunctional or polyfunctional crosslinking agents which have a halohydrin, glycidyl, aziridine or isocyanate unit or a halogen atom as a functional group, to give water-soluble condensation products which, in 20% strength by weight aqueous solution at 20° C., have a viscosity of at least 100 mPa.s.

These pigment slurries are used as an additive to the paper stock in the production of filler-containing paper, an increase in the drainage rate and an increase in the retention being achieved in comparison with the dispersant-free pigment additives used to date in the paper stock.

DE-B-24 36 386 discloses the use of nitrogen-containing condensation products which are obtainable by reacting (a) one nitrogen equivalent of a polyalkylenepolyamine which contains 15–500 alkyleneimine units with (b) 0.08–0.001 molar part of a polyethylene oxide which contains 18–90 ethylene oxide units and has been reacted at the terminal OH groups with at least an equivalent amount of epichlorohydrin at from 20° to 100° C., with formation of high molecular weight resins which are still water-soluble, as drainage accelerators and retention aids in papermaking. In the form of a 20–25% strength aqueous solution at 25° C., the water-soluble resins have a viscosity of more than 300 mPa.s.

It is an object of the present invention to provide pigment slurries which contain dispersants which do not adversely affect the efficiency of retention aids, drainage aids and sizes in the production of filler-containing papers.

SUMMARY OF THE INVENTION

We have found that this object is achieved, according to the invention, by aqueous pigment slurries which contain up to 80% by weight of a finely divided pigment in dispersed form and 0.1–5% by weight of at least one dispersant, if they contain, as dispersants, polyalkylenepolyamines having a molecular weight of at least 300 or water-soluble reaction products which are obtainable by reacting (a) polyalkylenepolyamines having a molecular weight of at least 300 and/or polyamidoamines grafted with ethyleneimine and (b) bifunctional or polyfunctional crosslinking agents which have a halohydrin, glycidyl, aziridine or isocyanate unit or a halogen atom as a functional group and which, in 20% strength by weight aqueous solution at 20° C., have a viscosity of at least 100 mPa.s. Such highly concentrated pigment slurries are used as an additive to the paper stock in the production of filler-containing paper.

DETAILED DESCRIPTION OF THE INVENTION

Suitable pigments are all pigments which can usually be used in the paper industry, for example calcium carbonate (in the form of lime, chalk or precipitated chalk), talc, kaolin, bentonite, satin white, calcium sulfate and titanium dioxide. The pigments may be both filler pigments and coating pigments. The particle diameter of the pigments is, for example, from 0.1 to 10 μm and is preferably below 2 μm for from 40 to 90% of the pigment particles. The pigments may be used both in pure form and in conjunction with previously added polyanionic milling assistants.

The aqueous pigment slurries are prepared, as a rule, at room temperature in a conventional apparatus, for example in a dissolver or a caddy mill. Since high shear forces act on the mixture of pigment, water and dispersant during the dispersing process, the temperature of the pigment slurries may increase during the preparation.

Aqueous pigment slurries are also obtainable by milling coarse-particled pigments in the presence of dispersants and water. This variant for the preparation of aqueous pigment slurries is particularly important for the preparation of highly concentrated chalk slurries.

Suitable dispersants are polyalkylenepolyamines having a molecular weight of at least 300. These compounds are preferably polyethyleneimines having molecular weights of at least 1200. The molecular weight of the polyethyleneimines may be up to 5,000,000.

The polyethyleneimines may be neutralized with organic acids, such as formic acid, acetic acid or propionic acid, or with inorganic acids, such as hydrochloric acid, sulfuric acid or phosphoric acid. Suitable polyethyleneimines or salts of polyethyleneimines have, for example, viscosities of 5–1500, preferably 25–700, mPa.s (Brookfield viscometer, 20 rpm), in 10% strength by weight aqueous solution at 20° C. The pH of the slurries may be varied within a wide range. It is, for example, 7–12, preferably 7–9.

A further class of dispersants comprises reaction products which are obtainable by reacting (a) polyalkylenepolyamines having a molecular weight of at least 300 with (b) bifunctional or polyfunctional crosslinking agents.

Preferred components (a) are the polyethyleneimines defined above and having molecular weights of up to 5,000,000 and polyamidoamines grafted with ethyleneimine. Products of this type can be prepared by allowing ethyleneimine to act on polyamidoamines in the presence of acids or Lewis acids, for example sulfuric acid, phosphoric acid or boron trifluoride etherate. Under the conditions described, ethyleneimine is grafted onto the polyamidoamine. For example, 1 to 10 ethyleneimine units can be grafted on per basic nitrogen group in the polyamidoamine, i.e. from about 10 to 500 parts by weight of ethyleneimine are used per 100 parts by weight of polyamidoamine The polyamidoamines are obtainable, for example, by reacting dicarboxylic acids of 4 to 10 carbon atoms with polyalkylenepolyamines which preferably contain from 3 to 10 basic nitrogen atoms in the molecule. Suitable dicarboxylic acids are, for example, succinic acid, maleic acid, adipic acid, glutaric acid, suberic acid, sebacic acid or terephthalic acid. Mixtures of carboxylic acids may also be used, for example mixtures of adipic acid and glutaric acid or maleic acid and adipic acid. Adipic acid is preferably used for the preparation of the polyamidoamines. Suitable polyalkylenepolyamines which are condensed with the dicarboxylic acids have been stated above, for example diethylenetriamine, triethylenetetramine, dipropylenetriamine, tripropylenetetramine, dihexamethylenetriamine, aminopropylethylenediamine and bisaminopropylethylenediamine. The polyalkylenepolyamines can also be used in the form of mixtures in the preparation of the polyamidoamines. The preparation of the polyamidoamines is preferably carried out in the absence of a solvent but, if required, may also be effected in inert solvents. The condensation of the dicarboxylic acids with the polyalkylenepolyamines is carried out at relatively high temperatures, for example at from 120° to 220° C. The water formed in the reaction is distilled off from the reaction mixture. The condensation can, if required, also be carried out in the presence of lactones or lactams of carboxylic acids of 4 to 8 carbon atoms. Usually, from 0.8 to 1.4 mol of a polyalkylenepolyamine are used per mol of dicarboxylic acid. The polyamidoamines thus obtainable have primary and secondary NH groups and are soluble in water. Polyamidoamines grafted with ethyleneimine are disclosed, for example, in U.S. Pat. No. 3,642,572.

Suitable bifunctional or polyfunctional crosslinking agents (b) are, for example, epihalohydrins, in particular epichlorohydrin, and α,ω-bis(chlorohydrin)polyalkylene glycol ethers and the α,ω-bisepoxides of polyalkylene glycol ethers, which α,ω-bisepoxides are obtainable therefrom by treatment with bases. The chlorohydrin ethers are prepared, for example, by reacting polyalkylene glycols with epichlorohydrin in a molar ratio of 1:at least 2 to 5. Suitable polyalkylene glycols are, for example, polyethylene glycol, polypropylene glycol and polybutylene glycols and block copolymers of $C_2$–$C_4$-alkylene oxides. The polyalkylene glycols may also contain the alkylene oxides on which they are based, in random distribution. The average molecular weights ($M_w$) of the polyalkylene glycols are, for example, from 200 to 6000, preferably from 300 to 2000, g/mol. Bischlorohydrin ethers of polyethylene glycols are preferably used. α,ω-Bis(chlorohydrin)polyalkylene glycol ethers of this type are described, for example, in U.S. Pat. No. 4,144,123. As likewise stated therein, the corresponding bisglycidyl ethers are formed from the dichlorohydrin ethers by treatment with bases. The nitrogen-containing condensation products which are described in DE-B-2 436 386 mentioned in connection with the prior art and which are obtainable by reacting polyalkylenepolyamines with bischlorohydrin ethers of polyalkylene glycols and are described there as drainage accelerators and retention aids are used, according to the invention, as dispersants for the preparation of the highly concentrated pigment slurries.

Other suitable crosslinking agents are α,ω-dichloropolyalkylene glycols, which are disclosed, for example, in EP-B-0 025 515. They are obtainable either by reacting dihydric to tetrahydric alcohols, preferably alkoxylated dihydric to tetrahydric alcohols, 1. with thionyl chloride with HCl elimination and subsequent catalytic decomposition of the chlorosulfonated compounds with elimination of sulfur dioxide, or by converting said alcohols
2. with phosgene with HCl elimination into the corresponding bischlorocarbonic esters and then obtaining α,ω-dichloroethers therefrom by catalytic decomposition with elimination of carbon dioxide.

Preferably used alcohol components are ethoxylated and/or propoxylated glycols, which are reacted with from 1 to 100, in particular from 4 to 40, mol of ethylene oxide per mol of glycol.

Other suitable crosslinking agents are α,ω-dichloroalkanes or vicinal dichloroalkanes, for example 1,2-dichloroethane, 1,2-dichloropropane, 1,3-dichloropropane, 1,4-dichlorobutane and 1,6-dichlorohexane. Examples of other crosslinking agents are the reaction products of at least trihydric alcohols with epichlorohydrin to give reaction products which have at least two chlorohydrin units; for example, the polyhydric alcohols used are glycerol, ethoxylated or propoxylated glycerols, polyglycerols having from 2 to 15 glycerol units in the molecule and, if required, ethoxylated and/or propoxylated polyglycerols. Crosslinking agents of this type are disclosed, for example, in DE-B-2 916 356. Other suitable crosslinking agents are those which contain blocked isocyanate groups, for example trimethylhexamethylene diisocyanate blocked with 2,2,3,6-tetramethylpiperidin-4-one. Such crosslinking agents are known, cf., for example, DE-A-4 028 285, as well as crosslinking agents containing aziridine units and based on polyethers or substituted hydrocarbons, e.g. 1,6-bis-N-aziridinohexane, cf. U.S. Pat. No. 3,977,923. It is of course also possible to use mixtures of two or more crosslinking agents for increasing the molecular weight.

The water-soluble reaction products which are contained, according to the invention, as dispersants in aqueous pigment slurries are prepared by reacting polyalkylenepolyamines having a molecular weight of at least 300 with the bifunctional or polyfunctional crosslinking agents stated under (b). The reaction is preferably carried out in a solvent, for example water. The reaction can be effected at from 10° to 200° C., preferably 30° to 100° C. If the reaction temperature is above the boiling point of the reactant or of the solvent, the reaction is carried out under superatmospheric pressure. The reaction is preferably effected in aqueous solution, so that water-soluble condensation products are obtained directly, the solids content of the aqueous solutions being from 10 to 35% by weight. The aqueous solutions have a viscosity of at least 100 mPa.s at a concentration of 25% by weight and at 20° C. The viscosity of the 25% strength aqueous solutions may be up to 10,000 mPa.s and is preferably 200–2000 mPa.s.

Preferred aqueous pigment slurries are those which contain, as the pigment, finely divided chalk and, as dispersants, polyethyleneimine having a molecular weight of at least 1200 or water-soluble reaction products which are obtainable by reacting (a) polyethyleneimines having a molecular weight of at least 300 and (b) bifunctional or polyfunctional crosslinking agents which have a halohydrin, glycidyl, aziridine or isocyanate unit or a halogen atom as a functional group.

Particularly efficient dispersants are those which are modified by reacting (a) polyethyleneimines having a molecular weight of at least 1200 and (b) epichlorohydrin, bisepoxides or bischlorohydrin ethers of polyethylene oxides and/or polypropylene oxides, each having average molecular weights of from about 200 to 2000, in a weight ratio (a):(b) of from 1:0.01 to 1:10, preferably from 1:0.01 to 1:1. The bisepoxides or bischlorohydrin ethers of polyethylene oxides and polypropylene oxides are derived either from block copolymers or from random copolymers of ethylene oxide and propylene oxide, and the block copolymers may contain ethylene oxide and propylene oxide as polymerized units in any desired ratios.

The aqueous pigment slurries contain the dispersants described above in amounts of from 0.1 to 5, preferably from 0.2 to 2, % by weight. The aqueous pigment slurries are used as an additive to the paper stock in the production of filler-containing papers, boards or cardboards. They are used in an amount such that the resulting filler-containing papers contain from 2 to 60, preferably from 5 to 30, % by weight of at least one type of pigment. The use of the aqueous pigment slurries as an additive to the paper stock in the production of filler-containing paper results in an increase in the drainage rate and an increase in the retention compared with the addition of dispersant-free pigment slurries and of pigment slurries which contain, for example, a low molecular weight polyacrylic acid as the dispersant. In contrast to low molecular weight polyacrylic acids, the dispersants contained in the novel pigment slurries have no interfering effect on paper sizing. During the process for the production of filler-containing papers with the use of the pigment slurries described above, for example paper sizing can also be carried out simultaneously in the presence of starch. Particularly suitable sizes are the alkyldiketene emulsions known for this purpose, for example $C_{16}/C_{18}$-alkyldiketenes, or synthetic polymer sizes which are disclosed, for example, in EP-B-0 257 412 and EP-B-0 276 770.

The novel aqueous paper slurries can be used for the production of all filler-containing paper, board and cardboard qualities, for example papers for newsprint, medium writing and printing papers, natural gravure printing papers and lightweight and base papers. The main raw material used for the production of such papers is groundwood, thermomechanical pulp (TMP), chemothermomechanical pulp (CTMP), pressure groundwood (PGW) and sulfite and sulfate pulp. In papermaking, the process chemicals usually used, such as the abovementioned sizes and retention aids, may also be present. The presence of anionic retention aids, such as high molecular weight copolymers of acrylamide and ethylenically unsaturated carboxylic acids, such as acrylic acid, methacrylic acid or maleic acid, is particularly preferred. Copolymers of this type have K values of more than 200 (determined according to H. Fikentscher in 5% strength aqueous sodium chloride solution at a polymer concentration of 0.1%, a pH of 7 and a temperature of 25° C.). Copolymers of acrylimide and acrylic acid which contain 5–95, preferably 10–50, % by weight of acrylic acid as polymerized units are preferred. The anionic retention aids are used in amounts of from 0.005 to 0.2, preferably from 0.005 to 0.04, % by weight, based on the weight of the paper fibers, in papermaking.

In the examples which follow, parts and percentages are by weight. The viscosities were determined in a Brookfield viscometer at 20° C. in 25% strength by weight solutions of the dispersants at 20 rpm. The ash content of the paper was determined according to DIN 54 370.

EXAMPLES

The following dispersants were used

Dispersant 1

Polyethyleneimine having an average molecular weight of 21,000 g/mol; the viscosity of a 25% strength aqueous solution was 35 mPa.s.

Dispersant 2

Reaction product of a polyethyleneimine having a molecular weight of 21,000 g/mol with the bischlorohydrin ether of polyethylene glycol having an average molecular weight of 1500 in a weight ratio of 1:0.12, the reaction product being neutralized to pH 7 with acetic acid.

Dispersant 3

A 25% strength aqueous solution of polyethyleneimine having a molecular weight of $1 \cdot 10^6$ g/mol, which solution was brought to pH 7 with acetic acid. A 25% strength aqueous solution had a viscosity of 220 mPa.s.

Dispersant 4

Reaction product of polyethyleneimine having a molecular weight of $1 \cdot 10^6$ g/mol with the bischlorohydrin ether of polyethylene oxide having an average molecular weight of 1500 in a weight ratio of 1:0.06. A 25% strength aqueous solution of this dispersant had a viscosity of 1200 mPa.s.

Examples 1 to 12

Preparation of chalk slurries

General method

In each case, 210 g of water and an amount of an aqueous solution of dispersants 1 to 4 such that the amount of dispersant had the solids content of 0.5 or 0.3% by weight, based on chalk, as stated in Table 1, were initially taken in a beaker having a capacity of 800 ml. Thereafter, 400 g of a finely divided chalk of the origin stated in Table 1 were stirred in with a high-speed laboratory stirrer in the course of 10 minutes. After the addition of the total amount of chalk, the slurries were each stirred for 15 minutes at a speed of 2500 rpm and the viscosity of the slurry was then determined in a Brookfield viscometer using spindle 1 at 20° C. The results are shown in Table 1.

TABLE 1

| Example | Chalk | Dispersant No. | Dispersant Amount [% solid] based on chalk | Solids content [%] of the slurries | Viscosity [mPa · s] of the slurries |
|---|---|---|---|---|---|
| 1 | DX 1 from Omya | 1 | 0.5 | 70 | 80 |
| 2 | " | 2 | 0.5 | | 60 |
| 3 | " | 3 | 0.5 | | 70 |
| 4 | " | 4 | 0.5 | | 80 |
| 5 | " | 4 | 0.3 | | |
| 6 | Hydrocarb OG (Omya) | 2 | 0.5 | 70 | 200 |
| 7 | " | 3 | 0.5 | | 120 |
| 8 | " | 4 | 0.5 | | 100 |
| 9 | Socal ® P3 (Solvay) | 2 | 0.5 | 50 | 30 |
| 10 | " | 3 | 0.5 | | 30 |
| 11 | " | 4 | 0.5 | | 35 |
| 12 | " | 4 | 0.3 | | 40 |

Examples 13 to 24

Production of filler-containing paper

A 0.2% strength stock suspension in water was prepared from 50% of spruce sulfite pulp and 50% of beech sulfite pulp. The pH of the stock suspension was 7.5 and the freeness was 35° SR (SchopperRiegler). The chalk slurries described in Examples 1–12 were then each added to this paper stock suspension in an amount of 40%, based on dry fibers, of chalk. Each of the 12 samples thus obtained was divided into 4 samples (a) to (d), the following amounts of anionic polyacrylamide (polymer of 70% of acrylamide and 30% of sodium acrylate, average molecular weight $10^7$ g/mol) then being added to samples (b) to (d).

Sample (a): 0% of anionic polyacrylamide

Sample (b): 0.005% of anionic polyacrylamide

Sample (c): 0.01% of anionic polyacrylamide

Sample (d): 0.02% of anionic polyacrylamide.

Samples (b) to (d), which contained an anionic polyacrylamide as a retention aid, were each drained in a laboratory sheet former with formation of sheets having a basis weight of 68 g/m$^2$, after the retention aid had acted for 30 seconds. Sheets having a basis weight of 68 g/m$^2$ were likewise produced from samples (a) in a laboratory sheet former. In order to determine the chalk content of the sheets and hence to obtain a measure of the retention of the chalk, the sheets were incinerated in a muffle furnace. The determination was carried out according to DIN 54370. The results obtained in each case for the retention are stated in Table 2.

Comparative Example 1

A 0.2% strength stock suspension in water was prepared from 50% of spruce sulfite pulp and 50% of beech sulfite pulp. The pH of the stock suspension was 7.5 and the freeness was 35° SR. 40%, based on dry fibers, of finely divided chalk (Hydrocarb 60 from Omya) were added to this stock suspension, and the filler-containing stock suspension was then divided into 4 samples (a) to (d). The anionic polyacrylamide stated in Examples 13 to 24 under samples (b) to (d) was added to samples (b) to (d) in the amounts likewise described there and, as described above, drainage was effected in a laboratory sheet former. The values for the filler retention are stated in Table 2.

Comparative Example 2

Comparative Example 1 was repeated, with the single exception that in this case a commercial slurry of cationically dispersed chalk (Hydrocarb 60 GUK from Omya) was used instead of the chalk powder employed there. The values determined for the filler retention are stated in Table 2.

TABLE 2

Retention (% by weight of chalk in the paper)

| Example | Chalk-slurry from Example | added amount of anionic polyacrylamide % 0 (a) | 0.005 (b) | 0.01 (c) | 0.02 (d) |
|---|---|---|---|---|---|
| 13 | 1 | 7.9 | 21.0 | 24.0 | 26.2 |
| 14 | 2 | 10.1 | 20.3 | 23.9 | 25.7 |
| 15 | 3 | 11.3 | 21.9 | 24.9 | 27.2 |
| 16 | 4 | 13.5 | 21.5 | 23.6 | 25.4 |
| 17 | 5 | 5.2 | 19.3 | 22.0 | 24.1 |
| 18 | 6 | 9.4 | 23.0 | 25.6 | 27.6 |
| 19 | 7 | 8.5 | 19.2 | 22.4 | 25.4 |
| 20 | 8 | 8.9 | 17.4 | 20.9 | 23.4 |
| 21 | 9 | 11.6 | 20.1 | 22.9 | 25.8 |
| 22 | 10 | 9.5 | 21.8 | 25.0 | 28.1 |
| 23 | 11 | 10.4 | 21.4 | 24.7 | 26.8 |
| 24 | 12 | 8.3 | 16.5 | 19.2 | 22.6 |
| Comparative Example 1 | without dispersant, Hydrocarb 60 | 2.7 | 9.6 | 13.2 | 16.1 |
| Comparative Example 2 | Hydrocarb 60 GUK (Omya) | 4.9 | 15.3 | 18.0 | 20.1 |

We claim:

1. An aqueous pigment slurry which contains up to 80% by weight of a finely divided pigment in dispersed form and from 0.1 to 5% by weight of at least one dispersant, which contains, as the dispersant, a water-soluble reaction product which is obtained by reacting (a) a polyamidoamine grafted with ethyleneimine and (b) a bifunctional or polyfunctional crosslinking agent which has a halohydrin, glycidyl, aziridine or isocyanate unit or a halogen atom as a functional group and which, in 25% concentration by weight aqueous solution at 20° C., has a viscosity of at least 100 mPa.s.

2. The aqueous pigment slurry as claimed in claim 1, which contains, as the pigment, finely divided chalk.

3. A process for the production of filler-containing paper, comprising adding an aqueous pigment slurry to paper stock to form a mixture and draining the mixture to form filler-containing paper, said aqueous pigment slurry containing up to 80% by weight of a finely divided pigment in dispersed form and from 0.1 to 5% by weight of at least one dispersant, which contains, as the dispersant, a water-soluble reaction product which is obtained by reacting (a) a polyamidoamine grafted with ethyleneimine and (b) a bifunctional or polyfunctional crosslinking agent which has a halohydrin, glycidyl, aziridine or isocyanate unit or a halogen atom as a functional group and which, in 25% concentration by weight aqueous solution at 20° C., has a viscosity of at least 100 mPa.s.

4. The process of claim 3, further comprising adding an anionic retention aid to the paper stock.

* * * * *